United States Patent [19]

Morita et al.

[11] 4,218,200

[45] Aug. 19, 1980

[54] ROTOR COOLING MEANS FOR ROTARY PISTON ENGINES

[75] Inventors: Yasuyuki Morita; Yasuhiko Iwamoto, both of Hiroshima, Japan

[73] Assignee: Toyo Kogyo Co., Ltd., Hiroshima, Japan

[21] Appl. No.: 919,453

[22] Filed: Jun. 27, 1978

[30] Foreign Application Priority Data

| | | | |
|---|---|---|---|
| Jun. 30, 1977 | [JP] | Japan | 52-87258[U] |
| Jun. 30, 1977 | [JP] | Japan | 52-87259[U] |
| Aug. 30, 1977 | [JP] | Japan | 52-117138[U] |
| Aug. 30, 1977 | [JP] | Japan | 52-117139[U] |

[51] Int. Cl.[2] ..... F01C 21/06

[52] U.S. Cl. ..... 418/84; 418/87; 418/94

[58] Field of Search ..... 418/84, 87, 94, 91, 418/142

[56] References Cited

U.S. PATENT DOCUMENTS

| | | | |
|---|---|---|---|
| 3,782,869 | 1/1974 | Steinwart et al. | 418/142 |
| 3,876,345 | 4/1975 | Froede et al. | 418/87 X |
| 4,011,032 | 3/1977 | Steinwart et al. | 418/84 |
| 4,174,197 | 11/1979 | Leitermann | 418/84 |

FOREIGN PATENT DOCUMENTS

| | | | |
|---|---|---|---|
| 51-29105 | 3/1976 | Japan | 418/94 |
| 1374307 | 11/1974 | United Kingdom | 418/94 |

*Primary Examiner*—Leonard E. Smith

*Attorney, Agent, or Firm*—Fleit & Jacobson

[57] ABSTRACT

Rotary piston engine includes a substantially triangular rotor formed with flank cooling oil passages located behind flanks of the rotor. The rotor further has coolant oil passages behind the oil seals at the opposite side surfaces thereof. The flank cooling oil passages are supplied with cooling oil only when the rotor temperature or engine speed is beyond a predetermined value, while the oil seal cooling passages are always supplied with cooling oil so that the rotor flanks can be maintained at a high temperature while preventing the oil seals from being excessively heated.

10 Claims, 3 Drawing Figures

ROTOR COOLING MEANS FOR ROTARY PISTON ENGINES

The present invention relates to rotary piston engines and more particularly to rotor cooling means for rotary piston engines.

Conventional rotary piston engines include oil seals provided on side surfaces of a rotor for sealing engagement with the inner surfaces of side housings and such oil seals have sealing members comprised of rubber or a similar resilient material which requires cooling in operation in order to ensure a prolonged working life. Further, the oil seals include sealing rings having sealing lips which are adapted to engage with the inner surfaces of the side housings and such sealing lips may possibly be deformed under an excessively high temperature resulting in a failure of sealing function.

Hithertofore, cooling of oil seals has been made by circulating totally or partially the cooling oil which has been used for cooling the flanks of the rotor. According to a recent development of rotary piston engines, there has been proposed to maintain the temperature of the combustion chamber as high as possible in order to accomplish an improved fuel economy and at the same time suppress the amount of pollutant emissions as low as possible. Thus, there is a tendency in recent rotary piston engines that the rotor temperature is maintained at a higher value than in prior engines so that the conventional rotor cooling arrangement is no longer effective providing satisfactory cooling of the oil seals. Therefore, it has become necessary to provide more effective cooling of the oil seals under an increased rotor temperature.

In Japanese utility model application Sho 49-101336 filed on Aug. 23, 1974 and disclosed for public inspection on Mar. 2, 1976 under the disclosure number Sho 51-29105, there is disclosed a rotary piston engine including a rotor which is formed with an oil passage in addition to the oil passages for cooling the rotor flanks. The additional oil passage is aimed to supply lubricant oil between the side housing and the rotor gear which is an internal gear secured to the rotor for meshing engagement with an external gear mounted on the side housing, and has a portion passing behind oil seals. Thus, the additional oil passage may have to some extent an effect of cooling the oil seals, however, the arrangement cannot provide a satisfactory result because the additional passage is provided only in the side of the rotor where the rotor gear is mounted so that it is not effective in cooling the oil seals on the other side of the rotor. Further, the additional oil passage is formed so as to extend only behind the outer oil seal so that it is not effective for cooling the inner oil seal. It should further be noted that the additional oil passage has a common inlet with the rotor flank cooling passage so that, when the supply of cooling oil is decreased for maintaining the temperature of the rotor flanks at a relatively high value, cooling of oil seals cannot be expected at all.

It is therefore an object of the present invention to provide rotor cooling means for rotary piston engines which can effect adequate cooling of oil seals while avoiding excessive cooling of rotor flanks.

Another object of the present invention is to provide rotor cooling means for rotary piston engines which includes two separate cooling oil flow systems one for cooling the rotor flanks and the other for cooling the oil seals.

A further object of the present invention is to provide rotor cooling means for rotary piston engines in which supply of rotor flank cooling oil is made intermittently on demand in accordance with the engine operating condition.

According to the present invention, the above and other objects can be accomplished, in a rotary piston engine comprising a casing which includes a rotor housing and a pair of side housings having inner surfaces and being secured to the opposite sides of the rotor housing to define a rotor cavity, a substantially polygonal rotor having opposite side surfaces and flanks defined between apex portions, said rotor being disposed in the rotor cavity in the casing for rotation with the side surfaces in confronting relationship with the inner surfaces of the side housing, oil seal means provided on the side surfaces of the rotor for sliding engagement with the inner surfaces of the side housings, rotor cooling means comprising circumferentially extending first coolant passage means formed in said rotor and located axially behind the oil seal means, second coolant passage means formed in said rotor and located radially behind the flanks of the rotor, means for providing continuous supply of coolant to said first coolant passage means, and means for providing supply of coolant to said second coolant passage means only on demand in accordance with engine operating condition. For example, the coolant may be supplied to the second coolant passage means when the rotor temperature exceeds a predetermined value. For the purpose, thermostatically controlled coolant nozzle means may be provided. Alternatively, the supply of coolant to the second coolant passage means may be controlled in accordance with engine speed or engine load.

In a preferable mode of the present invention, the first coolant passage means is provided with inlet means located radially inwardly of the apex portions so that the coolant is passed upon rotation of the rotor from leading side to trailing side of the passage means as viewed in the direction of the rotor rotation. In rotary piston engines of this type, due to the nature of combustion which takes place in the combustion chamber, there is a tendency that the rotor flank temperature is higher at the leading side than at the trailing side. Similar tendency also exists in the vicinity of the oil seals. Therefore, the aforementioned inlet arrangement is effective to introduce the coolant at the high temperature zone and have it flow to the low temperature zone so as to provide a satisfactory cooling of the oil seal means.

According to the arrangement of the present invention, the outlet means of the first coolant passage means is formed in the rotor and the coolant which has passed through the first coolant passage means is continuously discharged through the outlet means. In order to prevent the coolant discharged through the outlet means from being carried under a centrifugal force into the second coolant passage means and possibly causing excessive cooling of the rotor flank, it is preferable to direct the discharged coolant axially outwardly so that the coolant is returned to the reservoir without fail. For the purpose, baffle means may be provided at the outlet means of the first coolant passage means. Alternatively, the outlet means itself may be directed axially outwardly.

The first coolant passage means may include coolant passages disposed at both sides of the rotor and the passages may respectively have inlets and outlets. According to a preferable arrangement of the present invention, the coolant circulating paths comprised of the coolant passages with the inlets and the outlets at the opposite sides of the rotor have the same or equivalent flow resistances so that the effects of cooling become compatible at the both sides of the rotor. For the purpose, suitable flow restrictions may be provided in the coolant circulating paths.

The above and other objects and features of the present invention will become apparent from the following descriptions of preferred embodiments taking reference to the accompanying drawings, in which.

Figure 1:
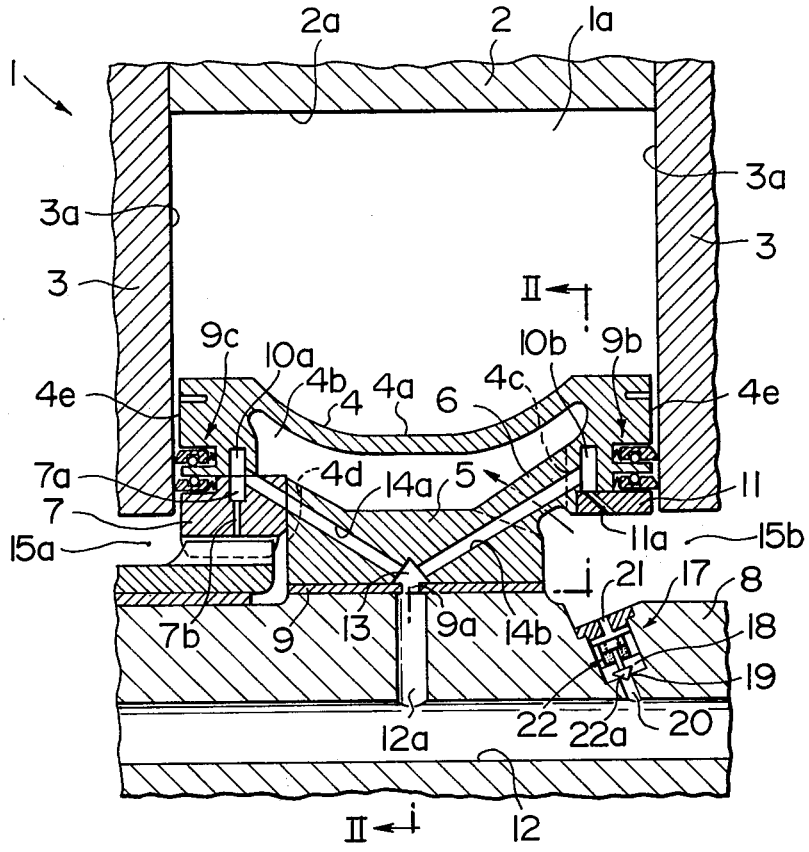
FIG. 1 is a fragmentary sectional view of a rotary piston engine including rotor cooling means in accordance with one embodiment of the present invention.

Referring now to the drawings, particularly to FIG. 1, the rotary piston engine shown therein includes a casing 1 comprised of a rotor housing 2 having an inner wall 2*a* of a trochoidal configuration and a pair of side housings 3 having inner surfaces 3*a* and secured to the opposite sides of the rotor housing 2 to define a rotor cavity 1*a*.

Figure 2:
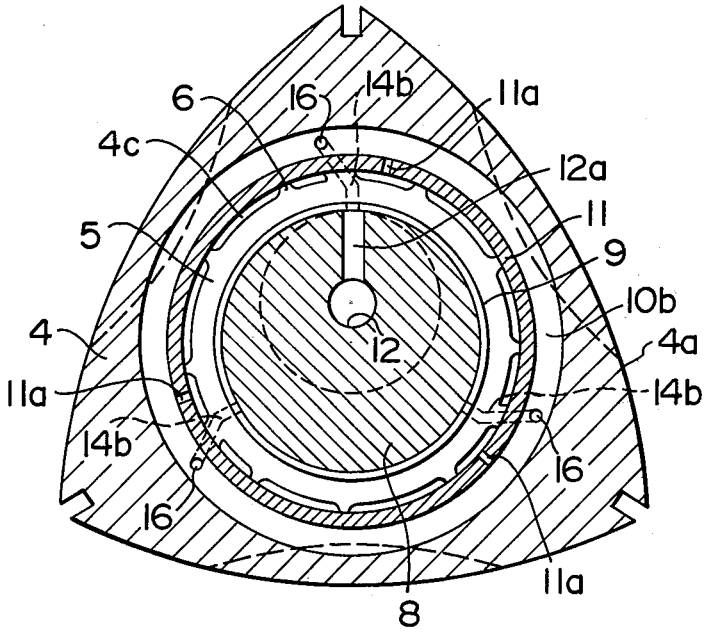
FIG. 2 is a sectional view taken substantially along the line II—II in FIG. 1.

In the rotor cavity 1*a*, there is disposed a rotor 4 which is of substantially triangular configuration having rotor flanks 4*a* as shown in FIG. 2. The rotor 4 is consisted of a body which has one or more cavities 4*b* extending along the rotor flanks 4*a*. It should of course be noted that only one cavity 4*b* may be formed in the body of the rotor 4 so as to extend along all of the rotor flanks 4*a* but a suitable number of separated cavities 4*b* may also be provided.

The rotor 4 has a boss 5 which is integrally formed at one axial end through a plurality of ribs 6 with the body of the rotor 4 so that a passage 4*c* is defined between each adjacent two ribs 6 to communicate with the cavity 4*b*. At the other axial end of the boss 5, there is mounted on the rotor 4 an internal gear or rotor gear 7. The rotor boss 5 is formed with recesses so that passages 4*d* are defined between the boss 5 and the rotor gear 7 to communicate the cavity 4*b* with the exterior of the rotor 4.

The rotor 4 is mounted on an eccentric shaft 8 through a bearing 9. Further, the rotor 4 has opposite side surfaces 4*e* on which oil seals 9*c* and 9*b* are mounted for slidable engagement with the inner surfaces 3*a* of the side housings 3.

Axially behind the oil seals 9*c* and 9*b* on respective sides, the rotor 4 is formed with cooling oil passages 10*a* and 10*b* which may be in the form of continuous circular grooves. Alternatively, each of the oil passages 10*a* and 10*b* may be comprised of annular grooves which may be located on a circle co-axial with the rotor 4. In the illustrated embodiment, the rotor 4 has inner and outer oil seals on each side and each passage 10*a* or 10*b* is formed so as to cover the axial inward side of both the inner and outer oil seals. On one side of the rotor 4, the groove or grooves constituting the oil passage 10*a* are closed at the radially inner side by the rotor gear 7 which has a groove or grooves 7*a* which are in communication with the passage 10*a*. The rotor gear 7 is further provided with one or more radial passages 7*b* leading from the groove or grooves 7*a* to the internal gear teeth formed thereon.

On the other side of the rotor 4, the groove or grooves constituting the oil passage 10*b* are closed by an annular member 11 which has one or more oil outlet passages 11*a* leading from the oil passage 10*b*. For the purpose to be described later, the passage 11*a* is inclined axially outwardly from the oil passage 10*b*.

The eccentric shaft 8 has an axially extending oil supply passage 12 whixh is adapted to receive a supply of lubricant and cooling oil from an oil pump (not shown). The eccentric shaft 8 is further formed with a radial passage 12*a* which extends from the passage 12. The rotor 4 is formed at the radial inner surface of the boss 5 with an annular groove 13 which communicates through a suitable number of apertures 9*a* in the bearing 9 with the radial passage 12*a* in the eccentric shaft 8. The groove 13 is connected respectively through passages 14*a* and 14*b* with the cooling oil passages 10*a* and 10*b*.

It should thus be understood that the oil in the passage 12 is continuously supplied through the radial passage 12*a*, the apertures 9*a* in the bearing 9, the groove 13 and the passages 14*a* and 14*b* to the cooling oil passages 10*a* and 10*b*. From the passages 10*a* and 10*b*, the oil is discharged respectively through the passages 7*b* and 11*a* to oil scavenging spaces 15*a* and 15*b*. The oil which has thus passed through the passages 10*a* and 10*b* provides effective cooling of the oil seals 9*c* and 9*b* which can therefore be maintained at relatively low temperatures during engine operation.

Since the outlet passage 11*a* is inclined axially outwardly from the passage 10*b*, it is possible to prevent the oil discharged through the passage 11*a* from being deposited on the rotor 4 and carried under centrifugal force through the passages 4*c* between the ribs 6 into the cavities 4*b*. Thus, the arrangement is effective in preventing any possibility of excessive cooling of the rotor flanks 4*a*. Further, the outlet passages 11*a* should preferably be designed in such a way that they provide appropriate restrictions to the oil flow passing therethrough so that the flow resistance through the passages 14*b*, 10*b* and 11*a* becomes substantially the same as that through the passages 14*a*, 10*a*, 7*a* and 7*b* for equalizing the cooling effects of the passages 10*a* and 10*b*.

Referring to FIG. 2, it will be noted that each of the passages 14*a* and 14*b* is opened to the respective passage 10*a* or 10*b* at a position radially inwardly of adjacent apex portion of the rotor 4 as shown by 16 in FIG. 2. The oil supplied through the port 16 to the passage 10*a* or 10*b* is therefore forced to flow counterclockwise circumferentially along the passage 10*a* or 10*b* from the leading side to the trailing side of the corresponding oil seals 9*c* and 9*b* as the rotor rotates clockwise. This arrangement is preferable in that the cooling oil is supplied at the high temperature side and forced to flow from this side to the low temperature side to maintain a substantially uniform temperature of the oil seals.

In order to supply cooling oil to the flank cooling cavities 4*b*, the eccentric shaft 8 is provided with one or more thermostatically controlled nozzle devices 17. The nozzle device 17 comprises a nozzle chamber 18 which is on one hand connected through a valve seal 19 and a passage 20 with the axial passage 12 and on the other hand opened to the oil scavenging chamber 15*b* through a nozzle opening 21 directed toward the ribs 6 and the passages 4*c* formed between the ribs 6. In the nozzle chamber 18, there is disposed a temperature responsive valve assembly 22 which has a valve member 22*a* co-operating with the valve seat 19.

The valve assembly 22 functions in accordance with the temperature of the eccentric shaft 8 to open the passage 20 to the valve chamber 18 by moving the valve member 22*a* apart from the valve seat 19 when the temperature of the eccentric shaft 8 is above a predetermined value. Since the temperature of the eccentric shaft 8 is considered as being substantially proportional to the engine temperature, it can be considered that the nozzle device 17 is opened when the rotor temperature is above a predetermined value. As soon as the nozzle device 17 is thus opened, the oil in the axial passage 12 is discharged through the nozzle device 17 toward the rotor 4.

The oil thus discharged through the nozzle assembly 17 may in part be introduced directly through the passages 4*c* into the cavities 4*b* and the remaining part may be deposited on the surfaces of the ribs 6 or adjacent portions of the rotor 4. The oil deposited on the ribs 6 or adjacent portions of the rotor 4 is then forced, as the rotor 4 rotates, into the cavities 4*b* under the influence of the centrifugal force. The oil thus introduced into the cavities 4*b* serves to cool the rotor flanks 4*a* and then discharged through the passages 4*d* and 4*c* to the scavenging spaces 15*a* and 15*b*, respectively.

According to the illustrated arrangement, the cooling oil is supplied to the cavities 4*b* for cooling the rotor flanks 4*a* only when the rotor temperature is above the predetermined value. Therefore, it is possible to maintain the rotor flank temperature at a comparatively high value. Even if the supply of cooling oil to the cavities 4*b* is thus limited, an adequate cooling can be maintained for the oil seals 9*c* and 9*b* by the cooling oil passages 10*a* and 10*b* which are continuously supplied with cooling oil.

Figure 3:
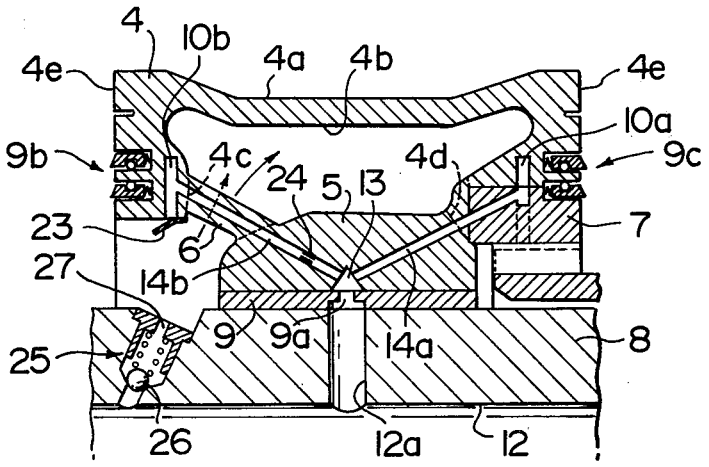
FIG. 3 is a fragmentary sectional view of a rotor having cooling means in accordance with another embodiment of the present invention.

Referring to FIG. 3 which shows another embodiment of the present invention, the basic construction of the engine is the same as that of the embodiment shown in FIGS. 1 and 2 so that corresponding parts are designated in FIG. 3 by the same reference numerals as in FIGS. 1 and 2. In this embodiment, the annular member 11 having outlet passages 11*a* in the previous embodiment is substituted by an annular baffle member 23 which functions to direct the oil from the passage 10*b* axially outwardly. In order to make the oil flow through the passage 10*b* substantially equal to that through the passage 10*a*, the passage 14*b* extending between the groove 13 and the passage 10*b* is provided with a restriction or orifice 24.

The thermostatically controlled nozzle device 17 is substituted by a pressure responsive nozzle device 25 which is comprised of a ball type check valve 26 and a discharge nozzle opening 27. When the pressure of oil in the passage 12 is greater than a predetermined value, the check valve 26 is opened under the oil pressure so that the oil is discharged through the nozzle device 25 toward the rotor 4. It will therefore be understood that in this embodiment cooling oil is supplied to the cavities 4*b* in accordance with the engine speed because the oil pressure in the passage 12 is proportional to the engine speed which may influence the engine temperature or rotor temperature.

The invention has thus been shown and described with reference to specific embodiments, however, it should be noted that the invention is in no way limited to the details of the illustrated arrangements but changes and modifications may be made without departing from the scope of the appended claims.

We claim:

1. In a rotary piston engine comprising a casing which includes a rotor housing and a pair of side housings having inner surfaces and being secured to the opposite sides of the rotor housing to define a rotor cavity, a substantially polygonal rotor having opposite side surfaces and flanks defined between apex portions, said rotor being disposed in the rotor cavity in the casing for rotation with the side surfaces in confronting relationship with the inner surfaces of the side housing, an eccentric shaft means for supporting the rotor, oil seal means provided on the side surfaces of the rotor for sliding engagement with the inner surfaces of the side housing; rotor cooling means comprising circumferentially extending first coolant passage means formed in said rotor and including first coolant path means located axially behind the oil seal means at one side surface of the rotor and second coolant path means located axially behind the oil seal means at the other side surface of the rotor, second coolant passage means formed in said rotor separately from said first coolant passage means and located radially behind the flanks of the rotor, said second coolant passage means having radially inwardly directed opening means, coolant supply passage means formed in the eccentric shaft means, said rotor having a boss adapted to be mounted on said eccentric shaft means and formed with first and second connecting passage means for connecting the coolant supply passage means in said eccentric shaft means respectively with the first and second coolant path means to provide continuous supply of coolant to said first and second coolant path means, temperature responsive discharge nozzle means provided in said coolant supply passage means in the eccentric shaft means and directed toward said opening means so that coolant discharged through the nozzle means is injected through the opening means into the second coolant passage means, said discharge nozzle means being provided with means for opening it only on demand in accordance with engine operating condition.

2. In a rotary piston engine comprising a casing which includes a rotor housing and a pair of side housings having inner surfaces and being secured to the opposite sides of the rotor housing to define a rotor cavity, a substantially polygonal rotor having opposite side surfaces and flanks defined between apex portions, said rotor being disposed in the rotor cavity in the casing for rotation with the side surfaces in confronting relationship with the inner surfaces of the side housing, oil seal means provided on the side surfaces of the rotor for sliding engagement with the inner surfaces of the side housing; rotor cooling means comprising circumferentially extending first coolant passage means formed in said rotor and located axially behind the oil seal means, second coolant passage means formed in said rotor and located radially behind the flanks of the rotor, means for providing continuous supply of coolant to said first coolant passage means, and means for providing supply of coolant to said second coolant passage means only on demand in accordance with engine operating condition, said first coolant passage means having outlet means directed axially outwardly from said first coolant passage means.

3. Rotor cooling means in accordance with claim 2 in which pressure responsive means is provided for supplying coolant to said second coolant passage means when coolant supply pressure exceeds a predetermined value.

4. Rotor cooling means in accordance with claim 2 in which the first coolant passage means is provided with inlet means located radially inwardly of the apex portions so that the coolant is passed upon rotation of the rotor from leading side to trailing side of the passage means as viewed in the direction of the rotor rotation.

5. Rotor cooling means in accordance with claim 2 in which said first coolant passage means has outlet means associated with baffle means for directing the coolant from the first coolant passage means axially outwardly of the rotor.

6. Rotor cooling means in accordance wth claim 2 in which the first coolant passage means includes first coolant path means passing behind the oil seal means at one side surface of the rotor and second coolant path means passing behind the oil seal means at the other side surface of the rotor, and means is provided in at least one of the first and second coolant path means for restricting coolant flow so that coolant flows through both path means are substantially equalized.

7. Rotor cooling means in accordance with claim 2 in which temperature responsive means is provided for supplying coolant to said second coolant passage means when rotor temperature exceeds a predetermined value.

8. Rotor cooling means in accordance with claim 7 in which supply of coolant is made through passage means in eccentric shaft means for supporting the rotor and said temperature responsive means is mounted on said eccentric shaft means so as to respond to temperature of the eccentric shaft means for supplying coolant to said second coolant passage means when the shaft temperature exceeds a predetermined value.

9. Rotor cooling means in accordance with claim 2 in which said outlet means is provided in annular member means secured to the rotor.

10. Rotor cooling means in accordance with claim 9 in which the first coolant passage means includes first coolant path means passing behind the oil seal means at one side surface of the rotor and second coolant path means passing behind the oil seal means at the other side surface of the rotor, said outlet means for at least one of the first and second coolant path means constituting flow restriction means for restricting coolant flow so that coolant flows through both path means are substantially equalized.

* * * * *